United States Patent [19]

Takami

[11] 4,016,023

[45] Apr. 5, 1977

[54] APPARATUS FOR AUTOMATICALLY BINDING PACKAGE

[76] Inventor: Masaho Takami, No. 9-50, Yamanote-cho, Korien Hirakata, Osaka, Japan

[22] Filed: July 16, 1975

[21] Appl. No.: 596,567

[30] Foreign Application Priority Data

| | | |
|---|---|---|
| July 18, 1974 | Japan | 49-87137 |
| Dec. 28, 1974 | Japan | 50-2936 |
| Mar. 13, 1975 | Japan | 50-32571 |

[52] U.S. Cl. ..... 156/359; 100/33 PB; 156/366; 156/499; 156/502; 156/522

[51] Int. Cl.[2] ..... B65B 13/32

[58] Field of Search ..... 156/359, 366, 502, 507, 156/512, 522, 526, 499; 81/9.1 R, 9.1 M; 100/2, 3, 8, 17, 25, 26, 27, 29, 32, 33 R, 33 PB

[56] References Cited

UNITED STATES PATENTS

| | | | |
|---|---|---|---|
| 3,316,687 | 5/1967 | Bartlett | 100/33 PB |
| 3,368,323 | 2/1968 | Wood | 100/33 PB |
| 3,397,105 | 8/1968 | Takami | 156/502 |
| 3,674,972 | 7/1972 | Stanhnke | 100/33 R |
| 3,749,622 | 7/1973 | Sato | 156/502 |
| 3,755,045 | 8/1973 | Takami | 156/502 |
| 3,771,436 | 11/1973 | Sato | 156/502 |
| 3,841,055 | 10/1974 | Takami | 100/33 PB |
| 3,858,503 | 1/1975 | Takahashi | 100/33 PB |
| 3,914,153 | 10/1975 | Sets | 100/33 PB |

*Primary Examiner*—Caleb Weston
*Attorney, Agent, or Firm*—George B. Oujevolk

[57] ABSTRACT

An automated package binding apparatus and an improved method to apply thereto in the welding of a thermoplastic tape winding round a package. Said apparatus may be common to known devices of the kind in various regards but being novel at least in the equipping of one or two bimetals element therein, said bimetal making possible the adjustment of the temperature of the heaters provided for cutting and melting thermoplastic tape. The invention contemplates the preliminary heating of said heaters to around 500°–700° C and applying of said heaters to the cutting and melting of the tape when the temperature is lowered to a suitable temperature around 400°–500° C through the lapse of time after cutting off the power supply to said heaters. The preliminary heating of said heaters facilitate the diffusion of heat uniformly on the entire surface of said heaters and accordingly uniform melting of said tape.

5 Claims, 10 Drawing Figures

FIG. 1
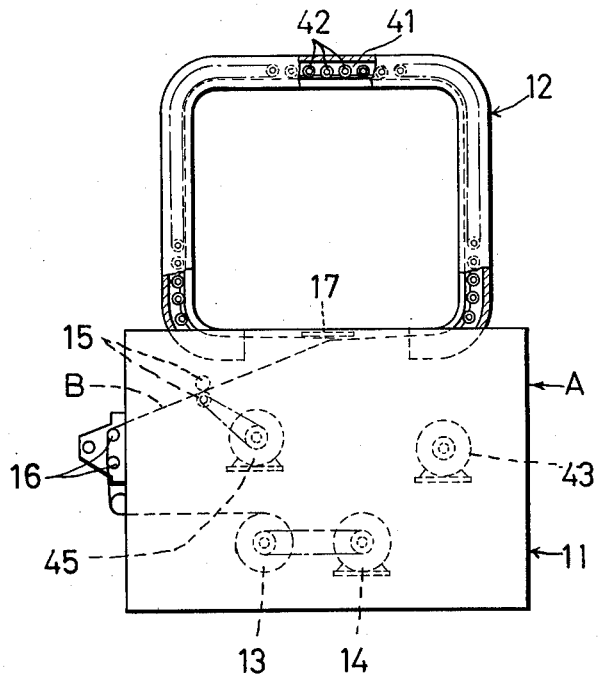
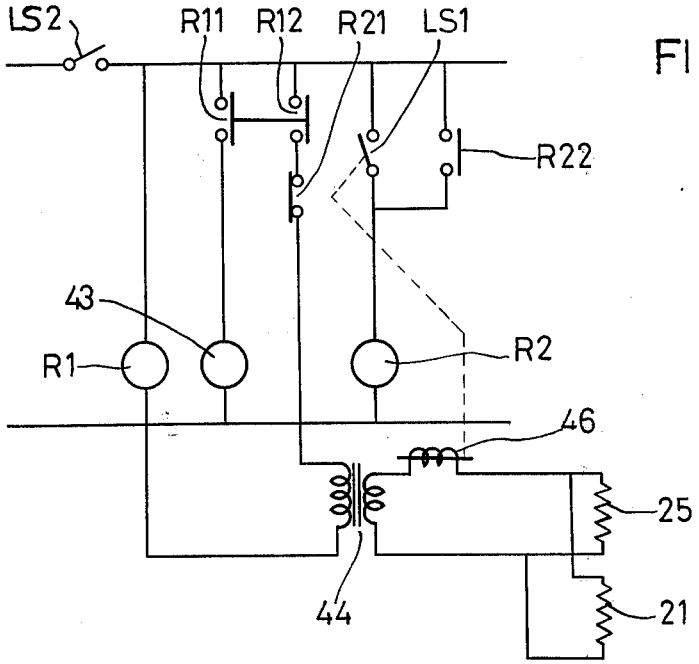
FIG. 5

APPARATUS FOR AUTOMATICALLY BINDING PACKAGE

This invention relates to a method and apparatus for automatically binding a package, and more particularly to an improved method and apparatus for automatically binding a package by welding a thermoplastic tape winding therearound in a constricted state, said apparatus being mechanized and rather less complex than known devices of this kind mainly due to the method applied in relation to a heater and a pressing device incorporated therein.

In case of known package binding machines, their heating capacity for melting the thermoplastic tape is usually maximized only around 300° C, said temperature being the maximum of heat transmissible to a metal plate as the heater from an electrified Nichrome wire which they incorporate. This temperature is short of satisfactorily melting the thermoplastic tape within a fraction of a second which is the preferred length of time for melting said tape in this invention.

It goes without saying that if the heater is retracted from the heat-applying position before the tape is suitably melted, i.e. said tape is yet in an adhesive state, with a device applying a pressure thereto for effectuating the tape welding, it will result in the adherence of said tape to said heater thereby causing slippage and slack of said tape. To make things worse, on the other hand, if the tape heating takes longer time, say, more than one second, so as to obtain enough melting thereof, it may result in the unsuitable loss of thickness of said tape even to be useless as a package binding.

Such a package binding machine as above-mentioned, accordingly, requires a complex cam-related mechanism so as to enable the retraction of the heater from the tape-melting position without causing trouble on the tape. To put it more in detail, a cam-mechanism interrupts the pressure application by temporarily moving said pressing device away from the pressure applying position when the heater is retracted from the tape melting position. In the foregoing process there is a likely development of trouble in that the thermoplastic tape because of its quick drying character is unsuitably dried from the melting state during the absence of pressure in the midst of the tape welding process.

This invention established a fundamental improvement in the tape heating means wherein a metal plate used as the heater is heated directly by electricity so that the metal plate may obtain a temperature as high as 700° C, the heater being preliminarily heated to around 500°–700° C at its core portion to be higher even than temperatures prescribed as suitable for the tape welding in this invention, said suitable temperature ranging from about 400° to 500° C. The heater starts on the tape melting work when the preheated temperature has been lowered to any of suitable temperatures, in this process the heater enabling the diffusion of the heat evenly all over the surface contributes to the uniform welding of the tape.

A primary object of this invention is to provide a method for welding a package binding thermoplastic tape in which a comparatively high heat is applied by a heater to said tape in a comparatively short time so that said tape may be suitably melted without losing its thickness and the heater may be retracted smoothly without interrupting the pressure for the tape welding.

A second object of this invention is to provide a method for welding a package binding thermoplastic tape in which the heater is preliminarily heated to a temperature higher than suitable for the tape melting thereby starting on the tape heating work when said excessive temperature has been lowered to a suitable temperature through the lapse of time after suspension of the power supply.

A third object of this invention is to provide a package binding apparatus for applying the above-mentioned methods thereto, in said apparatus the heater being heatable precisely as required by means of a switch and a bimetal element therein.

A fourth object of this ivention is to provide an apparatus as above-mentioned wherein said bimetal element is not damaged as the result of its heat transformation by means of disposing an additional bimetal element parallel therewith.

A fifth object of this invention is to provide an apparatus wherein the heater for melting the tape and the heater for cutting the tape are electrically connected to each other so that said two heaters can be placed under simultaneous temperature control.

These objects of this invention will be accomplished by embodiments as referred to in relation with the annexed drawing of this invention as following.

FIG. 1 is a partially broken front view of a package binding machine of this invention.

FIG. 5 is a wiring diagram showing electric circuits of the tape cutting and tape melting heaters.

Figure 2:
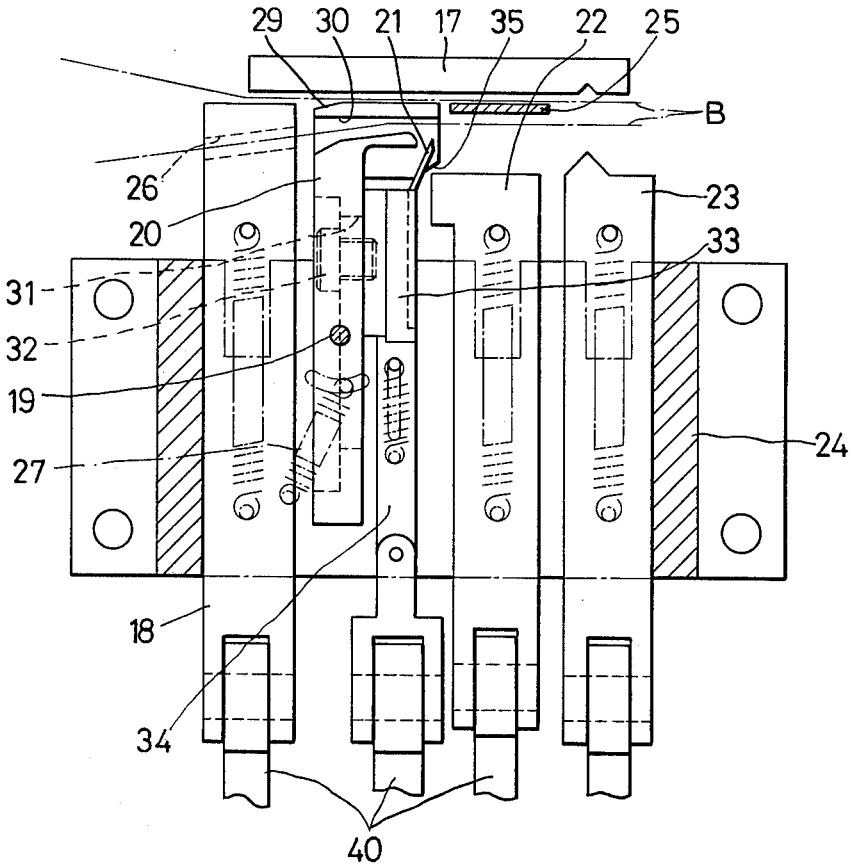
FIG. 2 is a vertical sectional front view in magnified scale showing a mechanism for cutting and welding a package winding tape incorporated in the above-mentioned machine.

Generally speaking, the package binding machine A comprises integral mechanical parts housed therein and externally-disposed equipment including a case 11 on which a package to bind is loaded, a tape guide channel 12 internally forming a dovetail groove 41 being adapted to said case 11 so as to be erecting thereon but partially extending at its lower portion inside said case 11, said channel 12 in other words vertically extending from one end to the other end in a form like a square rounded at its corners, both of said ends of said channel 12 being open inwardly inside said case 11 so as to allow extension of the tape therethrough, the vertical inside space of said square-like form being spacious enough for admitting a package placed on said case 11, the above-described outline being clear in FIG. 1.

At the inside periphery of said guide channel 12 through said dovetail groove 41 are disposed a number of rollers 42 keeping a predetermined interval, said rollers 42 guiding the tape B upon its advancing into said groove 41 by a pair of tape forwarding rollers 15 thereby lessening the contacting resistance between the tape B and said inside peripheral surface enabling the smooth movement of said tape B within said dovetail groove 41.

In said case 11 are incorporated a reel 13 wound with a thermoplastic tape B, a motor 14 for winding said tape B on said reel 13, a motor 45 for rotating the tape forwarding rollers 15, and a motor 43 as shown in FIG. 1, motor 43 giving up-and-down movements to various integral parts also housed in said case 11, as displayed in FIG. 2.

The tape B pulled out from reel 13 is guided by the pair of rollers 15 within case 11 so that tape B at the front tip thereof may advance into the right-side terminal portion of guide channel 12 as seen in FIG. 1. In the traveling route of tape B are arranged, besides the above-mentioned rollers 15, a group of rollers 16 for adjusting the tension of tape B around the package by means of a suitable resistance against the tape constriction by the rolling of said tape in reel 13 under the motive power of motor 14. (Hereinunder, "left" and "right" designate directions based on the annexed drawing.)

A table 17 is disposed so as to be positioned right above tape B at a squarely hollow portion at the upper wall of case 11, said hollow portion having a groove-like element for supporting table 17 at a level slightly higher than the end openings of channel 12 but lower than the upper surface of said upper wall so that table 17 make no contact with the above-mentioned package placed on said upper wall, table 17 being removable slidingly at right angle to the tape extending direction on said groove-like element by the functioning of a cam system (not shown) upon completion of the tape welding process.

Below table 17 at a position right under the tape B are arranged in a line from left to right as shown in FIG. 2: a first clamp 18 movable up and down; a fitting table 20 intermediately pivoted by a pin 19 so as to be rockable in the longitudinal direction of tape B; a tape cutting heater 21 fitted to fitting table 20 so as to be movable up and down along table 20; a pressing device 22 and a second clamp 23, both movable up and down, the foregoing arrangement in a line being enabled by the support of a guide frame 24 fixed to said case 11.

Figure 3:
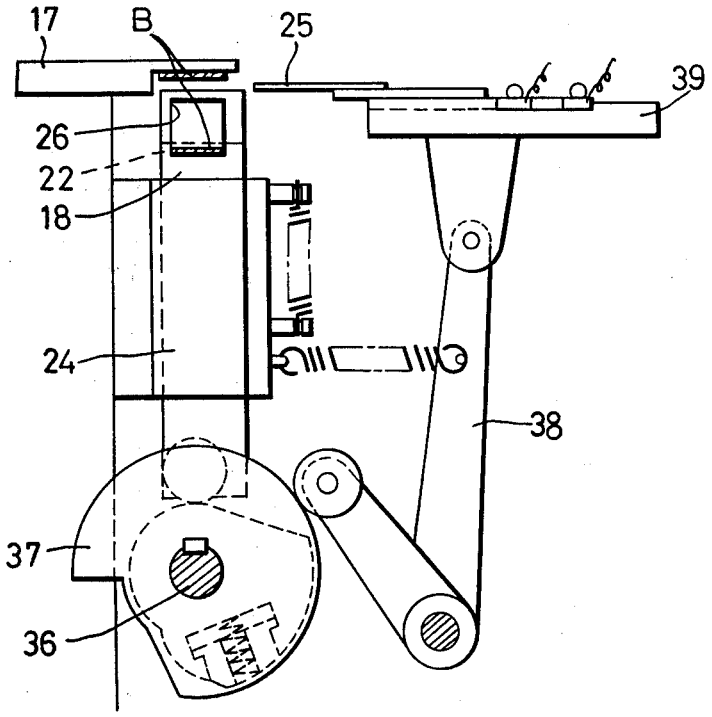
FIG. 3 is a vertical sectional side view of the above.

A heater 25 for fusing the tape B is installed so as to be movable into and away from space between vertically confronting end portions of the tape B right above the pressing 22, heater 25 being shown positioned vertically between pressing device 22 and table 17 to the right in FIG. 3.

The first clamp 18 at its upper end portion is provided with an aperture 26 to allow the tape B to extend therethrough, said clamp 18 at an uplifted position clamping the tape B at its front tip between the upper surface of clamp 18 and the under surface of table 17 upon reaching tape B below the under surface of table 17 after its round trip through the dovetail groove 41 of guide channel 12.

Said fitting table 20 by means of its connection with a spring 27 is urged to its upright posture, and at its upper end portion 29 projecting toward pressing device 22, said upper end portion 29 forming a laterally-opened groove 30 through which the tape B forwards on its travel from aperture 26 toward tape guide channel 12.

The fitting table 20 further is provided with a vertical slot 31 thereby allowing the fitting of a tape cutting heater 21 to table 20 via an electric insulator 33 by a screw 32 extending through slot 31, the under surface of insulator 33 connecting to a link 34 by means of which heater 21 is provided its up and down movement.

Said heater 21 is able to cut the tape under the dual effects of heat and blade, said heater 21 being elevated by link 34 so as to press at its front blade the tape against the upper wall of groove 30 thereby cutting tape B at a portion adjacent the right end opening of groove 30, said tape B thus having both end portions thereof overlapping each other whereby the afore-mentioned first clamp 18 clamps said end portion against the under surface of said table 17, the second clamp 23 joining the first clamp 18 in said clamping later.

The pressing device 22 presses the confronting end portions of tape B against the under surface of table 17 such that heater 25 is inserted between said confronting portions, the pressure application continuing further after retreat of heater 25 therefrom until completion of the tape welding.

The afore-mentioned fitting table 20 at the upper end thereof projects into the vertically moving scope of pressing device 22 at its upper end portion thereby enabling the sliding contact of said pressing device 22 on its upward movement with table 20 at a slanting surface 35 formed at the lower right corner of projective upper portion thereof as manifested in FIG. 2. Said table 20 as the result can make counterclockwise rocking.

The pressing device 22 moves upward after the leftward movement of heater 21 together with fitting table 20 from the tape cutting position upon completion of the tape cutting by heater 21, no trouble being caused in the tape welding process that follows, accordingly.

The second clamp 23 ascends after constriction of the tape B by the reel 13 thereby clamping the overlapping end portions of the tape B between its upper surface and under surface of table 17 thereby preventing the constricted tape B from loosening as referred to hereinbefore.

The tape welding heater 25 fixed to a table 39 as shown in FIG. 3 provides its back and forth movement due to the rotation of a cam 37 placed around a shaft 36 and through the medium of a link 38, heater 25 entering in between the overlapping end portions of the tape B simultaneous with the uplifting of pressing device 22, said heater 25 retracting from the sandwiched position upon completion of its tape melting work.

The up-and-down movement of the afore-mentioned first clamp 18, tape cutting heater 21, pressing device 22, second clamp 23, and the horizontal movement of the table 17 and the tape melting heater 25 proceed in timed relation with each other by the functioning of cams 37 and 40 adapted around cam shaft 36, cam shaft 36 on its one rotary movement bringing to completion one cycle of the tape welding work in this invention.

Figure 6:
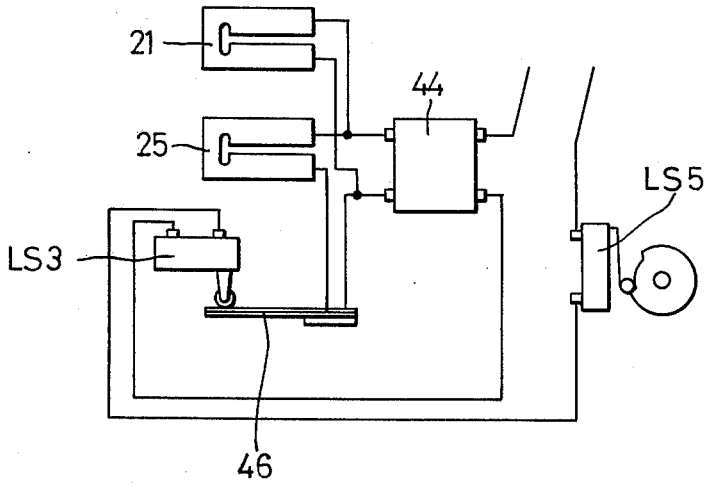
FIG. 6 is a diagram of wiring in control of the tape cutting and melting heaters with the use of a bimetal element.
Figure 8:
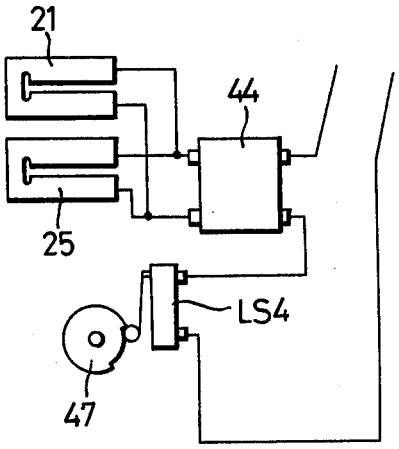
FIG. 8 is a wiring diagram of FIG. 6 in case of providing a cam mechanism.

As described heretofore, the package binding machine A accommodates heaters 21 and 25 composed of metal plates as displayed in FIG. 6 and 8, heaters 21 and 25 being so organized as to obtain electric heat as required in comparatively a short time and to obtain the available highest temperature at their leftward tip due to notches provided longitudinally from the right end so as to be quicker for obtaining heat.

For feeding electricity heaters 21 and 25 for one cycle of the tape cutting and melting works, a circuit is used as shown in FIG. 5.

Figure 4:
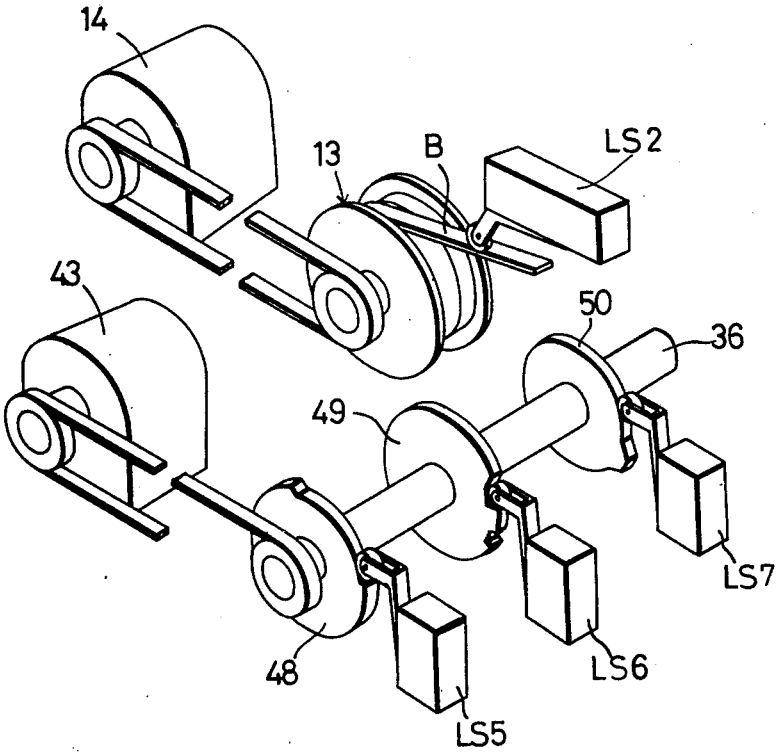
FIG. 4 is a perspective view displaying a driving mechanism of the above-mentioned package binding machine.

In order to activate the afore-mentioned cam shaft 31, a motor 43 shown in FIG. 4 and relays R1 and R2 manifested in FIG. 5 are linked with each other in a row, thereby connecting contact A (R11) of the relay R1 with motor 43 in series. A transformer 44 is connected in series with contact R21 of the relay R2 and contact R12 of the relay R1, and further a switch LS1 under the control of a bimetal element 46 is connected with said relay R2 in series, at the circuit of which a contact R22 is provided so as to keep said relay R2 latched on.

To the secondary circuit of the transformer 44 are connected the heaters 21, 25 and the bimetal element 46, said bimetal 46 by a predetermined amount of electricity therefore enabling the acquisition of a predetermined transformation thereof and accordingly enabling the closing of switch LS1 that results in the cutting of power supply to heaters 21 and 25.

In the drawing, LS2 designates a switch taking two parts, i.e. bringing motor 14 to a stop by opening switch LS7 as it detects the predetermined tension of the package-binding tape and simultaneously electrifying motor 43 and transformer 44 by actuating relay R1 and as a result closing contact R11 and R12, concurrently power being turned on for heaters 21, 25 and bimetal element 46. Bimetal 46, upon accomplishing its predetermined transformation simultaneous with the attainment of a predetermined temperature by heaters 21, 25 provides the closing of said switch LS1.

With the closing of the switch LS1 the relay R2 functions with the result that the contact R21 opens and the contact R22 closes, the opening of contact R21 resulting in the suspension of the power supply to the transformer 21 thereby turning off power for both heaters 21, 25 and bimetal element 46, said bimetal element 46 returning to its original form thereby opening said switch LS1 but keeping the relay R2 by the contact R21 and accordingly keeping the contact R21 opened.

As hereinbefore described, no power may be supplied to heaters 21, 25 and bimetal element 46 until suspension of power supply to the relay R2, thus providing power supply for every cycle of the package binding work without causing any failure.

The tape welding temperature is preferable to be around 400°–500° C. In said temperatures the tape B may be free from the viscosity at the time of withdrawing heater 25 from the tape melting position thereby enabling the retraction of said heater without interruptng the pressure applying, thus enabling the simplification of the package binding machine besides enabling the melting of the tape surface at said temperatures within a fraction of a second that may cause no loss of thickness of the tape. Furthermore, the heater 25 is preliminarily heated to around 500°–700° C, starting on the tape melting after a lapse of time when the temperature has dropped to around 400°–500° C with a result that the heat has diffused uniformly all over the heater's surface thereby enabling uniform melting of said tape.

Figure 7:
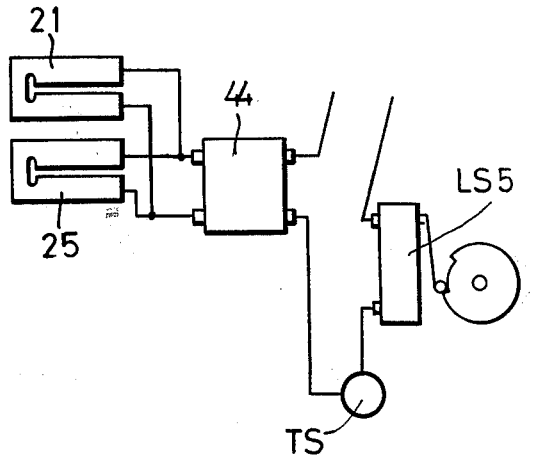
FIG. 7 is a wiring diagram of FIG. 6 in case of providing a timer.

The aforementioned heating process is illustrated in FIG. 6 to 8.

In case of FIG. 6, the heaters 21, 25 and the bimetal element 46 are arranged along the secondary circuit of the transformer 44 so that the bimetal element 46 may turn on and off a switch LS3 incorporated along the primary circuit of transformer 44, thus the heaters 21 and 25 can obtain a predetermined temperature by establishing a space between switch LS3 and bimetal element 46.

FIG. 7 shows an example of using a timer switch TS1, wherein switch TS1 is disposed along the primary circuit of transformer 44, switch TS1 working on temperature adjustment of heaters 21 and 25 by establishing a timed power supply.

FIG. 8 shows an example of using a cam system wherein a switch LS4 in the primary circuit of transformer 44 is turned on and off by a cam 47 rotated by an actuating means (not shown) provided within this package binding machine thereby enabling the temperature adjustment of said two heaters.

FIG. 4 shows an example of an electrical system for the heaters 21 and 25 in relation to driving means for constricting and forwarding tape B, said driving means comprising a cam shaft 36 to be driven by the motor 43 and three additional cams 48, 49 and 50. At the outer periphery of the cam 48, as shown in FIG. 6 and 7, is a switch LS5 connected to the primary circuit of the transformer 44 thereby enabling the power supply to said heaters 21 and 25 by the rotation of said cam 48.

The cam 47 and switch LS4 in the example of FIG. 8 correspond to cam 48 and switch LS5 respectively in FIG. 6 and 7, said cam and switch working directly on the control of temperatures for said heaters 21 and 25.

Now referring to FIG. 4 again, at the outer periphery of cam 49 also is a switch LS6 for the control of motor 43, switch LS6 together with the cam 49 functioning to interrupt the motor 43 after a predetermined rotary movement thereof thereby providing a time for constricting the tape B around a package and allow said motor 43 to start on rotary movement again after completion of the tape constriction. Said tape constriction is provided by a switch LS7 disposed at the outer periphery of cam 50, said switch LS7 starts rotating the tape constricting motor 14 when the motor 43 is brought to interruption by the afore-mentioned cam 49 and the switch LS6, said switch LS7 being switched off by the switch LS2 as it detects the predetermined tension of tape B thereby bringing to stop the motor 14.

In the example in FIG. 6 the temperatures of the heaters 21 and 25 are controlled by the bimetal element 46, said bimetal element 46 may be subjected to the atmosphere temperature to cause a deformation prior to its mechanically required transformation thereby causing aberration on the control of the heaters' temperatures.

This may be prevented by the preliminary control of space between the bimetal element and the switch or providing an equivalent bimetal element additionally to attach to the switch at its actuating member so that said member may move in accordance to the transformation of the attached bimetal element simultaneous with the same transformation of the "prime" bimetal element as illustrated later relative with FIG. 10.

Figure 9:
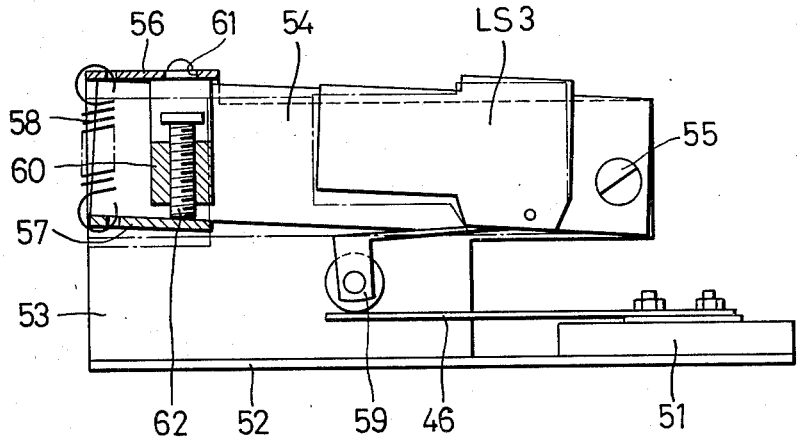
FIG. 9 is a longitudinal sectional front elevation manifesting the disposition of a bimetal element for the control of the heaters temperature.

The adjustment of distance between the bimetal element 46 and the switch LS3 is illustrated in FIG. 9 wherein a plate 52 to which the bimetal element 46 is fitted via an insulator 51 at its one side edge is provided with a side wall 53 erecting upright, said side wall 53 at the upper portion thereof having a rocking plate 54, said rocking plate 54 at its right-side end portion being pivotally fixed to side wall 53 by a screw 55 so as to be able to rock at its left end portion vertically around screw 55.

At the upper edge of side wall 53 to the left is formed a projective upper wall 56 horizontally projecting toward fitting plate 52, a spring 58 being stretched between said upper wall 56 and a lower wall 57 formed at the lower edge left end portion of rockable plate 54, spring thereby giving upward urge to rockable plate 54.

The switch LS3 is fixed intermediately on plate 54 so as to confront the bimetal element 46 at its front tip. The afore-mentioned upper wall 56 at its under surface is installed with an element 60 provided with a screw 62 which is rotationally operatable through a perforated hole 61 bored on upper wall 56, said screw 62 at its lower end receiving the lower wall 57 of said rocking plate 54.

Accordingly, rocking plate 54 may rock vertically around screw 55 by the operation of screw 62 thereby changing the space between switch LS3 at its actuating element 59 and bimetal element 46, this space adjustment enabling the control of electric time for the heating of the heaters 21 and 25 as required.

Figure 10:
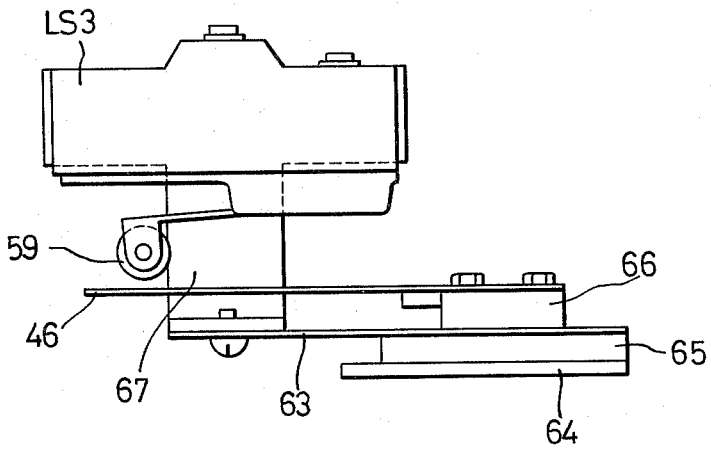
FIG. 10 is a front elevation showing a mechanism to make up for aberrations caused on the bimetal element in the second embodiment of this invention apparatus.

FIG. 10 shows the second embodiment of this invention wherein an additional bimetal element 63 is provided in the state of attaching to switch LS3 at its actuating element 59 so that bimetal element 63 may accomplish a transformation at the same time with the "switch controlling" bimetal element 46 under the influence of the atmospheric temperature thereby enabling the movement of switch LS3 quite in accordance to the transformation of said bimetal element 46 and accordingly the prevention of said bimetal element 46 from aberrations that may be caused otherwise by said natural temperatures.

In FIG. 10, the plate 64 is fitted with the bimetal element 46 via an insultor 65, said bimetal element 46 connecting to the additional bimetal element 63 via a wiring at the terminal 66 so that both of said bimetal elements 46 and 63 make equivalent transformation in the same direction, bimetal elements 46 and 63 being made of a same material in same size and being placed in parallel with each other. Or, they may be constructed in disregard of the material and size provided that they make the same transformation under a same temperature anyway.

The bimetal element 63 fixes at its forward portion to a plate 67 directing upward, said plate 67 at the upper portion at one side surface thereof being provided with the switch LS3 in a state that the actuating element 59 thereof abuts downward against the bimetal element 46.

By the functioning of bimetal elements 46 and 63, thus the distance between switch LS3 and the bimetal element 46 may be maintained invariably in disregard of the weather-caused transformation of bimetal element 46 and accordingly enabling said heaters to obtain a predetermined temperature constantly.

Further in FIG. 10, a possible deformation of bimetal element 46 caused by a remaining heat at the terminal 66 may be covered also by the simultaneous and equivalent deformation of the additional bimetal element 63.

The package binding operation by the foregoing package binding machine A according to examples in the first embodiment displayed in FIG. 1–4 will be explained below.

In the state that a package is placed on case 11 so as to be surrounded by the guide channel 12, an actuating switch (not shown) is depressed for starting this machine.

With the rotary movement of said tape forwarding rollers 15 moved by the motor 45, the tape B pulled out from the reel 13 is brought at its forward tip into the dovetail groove 41 passing through the aperture 26 of the first clamp 18 and the groove 30 of the fitting plate 20, said tape B guided by the roller 42 extending through said dovetail groove 41 counterclockwise thereby reaching at its front tip to underneath of said table 17, the tape B as indicated by a broken line in FIG. 1 thereby coming into a state that its forward tip portion and its intermediate portion under said table 17 vertically confront each other, said forward tip portion taking the upper position, said tape forwarding rollers 15 coming to a stop at this state.

The motor 43 thence starts rotary movement followed by the ascent of the first clamp 18 driven by the cam system 10 thereby clamping said tape B at its forward tip portion against the under surface of said table 17, simultaneously said heaters 21 and 25 being electrified bt the functioning of said cam 48 and switch LS5. Thence the motor 43 is interrupted by the cam 49 and the switch LS6, simultaneously the cam 50 and the switch LS7 starting to rotate the motor 14 and accordingly the reel 13 to the constriction of the tape B, said tape B thereby being forced to come out of said dovetail groove 41 and wind around said package in the state that said tape at its forward tip is firmly held by the afore-mentioned clamp 18. Upon reaching a predetermined tension of the tape B as the result of a continuous constriction thereof so as to firmly bind said package, that is to be detected by said switch LS2, the motor 14 is brought to a stop by said switch LS2 simultaneously said motor 43 again starting on movement of various tape welding members in timed relationship, starting with the elevation of the second clamp 23 by the cam shaft 36. The clamping of the tape B at said confronting portions by said second clamp 23 is followed by the descent of the first clamp 18 and simultaneous elevation of the tape cutting heater 21, said heater 21 cutting the tape at the underside portion of said confronting portion thereof. Said heater 21 in this state, together with the tape melting heater 25, has obtained the required temperature through the preliminary heating as mentioned already hereinbefore, although, needless to say, said required temperature 400°–500° C may not necessarily be required for said tape cutting.

The tape melting heater 25 thence moves in between said confronting end portions of tape B followed by timed elevation of the pressing device 22 so that said device 22 applies a pressure to said overlapping portions sandwiching heater 25 in between against the under surface of table 17, said pressing enabling the suitable contact of heater 25 with said overlapping tape surfaces at the afore-mentioned suitable temperature thereby fusing said tape surfaces in a suitable state. Said heater 25 upon completion of the predetermined tape melting retracts therefrom without necessitating the removal of said pressing device and without causing defects on the melted tape surfaces, this advantage being attrubutable to the suitable heating of said tape at the preferable temperature in a so short length of a time as a fraction of a second, needless to say.

After withdrawal of heater 25 therefrom, the pressing continues for a while until said overlapping portions become completely welded. Thence, the pressing device 22 together with the second clamp 23 descend to their respectively stationary positions followed by the lateral movement of said table 17 from between said case 11 and said package. In the above process, the cam shaft 36 has accomplished one rotation, said cam 49 and switch LS6 working to stop the motor 43 thereby bringing one cycle of the package binding work to a completion.

As may be apparent in the foregoing description, this invention can effectuate the package binding work more efficiently with a comparatively simplified mechanism wherein is discarded the conventionally required cam system for the interruption of the pressure applying function in the midst of the tape welding process. Also, this invention enables the heater to function to the best of its efficiency by heating it preliminarily to a temperature higher than suitable for the tape melting thereby enabling the diffusion of heat evenly all over the surface thereof and accordingly the uniform melting of said tape at its overlapping end portion.

What is claimed is:

1. A package taping machine comprising:

a. a case (11) with a top for resting a package thereon and having openings at the top, a tape guide channel (12) over said opening to guide a tape around a package;

b. a tape table (17) slidable in the case below said opening;

c. a tape pay-off reel (13) in the case for feeding a thermoplastic tape up through said opening and around a package on the case and then through the opening below said table again;

d. a first clamping element (18) elevatable towards the table so as to hold the end portion of the tape against said table;

e. a second clamping element (23) elevatable towards said table so as to hold the overlapping portions of the tape against said table;

f. a rockable tape guide element supporting a vertically slidable tape cutting heater;

g. a pressing element (22) elevatable towards said table so as to press the overlapping portions of the tape against said table;

h. time control cams coupled to said first clamping element, tape guide elements, pressing element and second clamping element, all said elements being aligned successively in the lengthwise direction of the tape, said time control cams adapted to elevate said elements by direct contact with said elements in timed relation with each other;

i. a welding heater (25) adapted to be transversally inserted between the overlapping portions of the tape to be pressed against the table by said pressing element; and, j. a bimetal element temperature control connected to said welding heater for controlling its heating temperature.

2. A package taping machine as claimed in claim 1, wherein said bimetal element temperature control means for controlling a heating temperature comprises a bimetal element disposed in series with said welding heater, and a switch actuated by said bimetal element so as to stop the electric supply to the heater at a predetermined temperature.

3. A package taping machine as claimed in claim 2, wherein an adjustment means is provided for adjusting a space between said bimetal element and switch.

4. A package taping machine as claimed in claim 1, wherein said bimetal element temperature control means for controlling a heating temperature comprises a first bimetal element for actuating a switch connected to said welding heater, and a second bimetal element supporting said switch, said first and second bimetal elements being deformable in the same direction at the same rate so as to maintain a predetermined space between the first bimetal element and the switch.

5. A package taping machine comprising:

a. a case (11) with a top for resting a package thereon and having openings at the top, a tape guide channel (12) over said openings to guide a tape around a package, b. a tape table (17) slidable in the case below said openings, rockable tape guide means (20) below said table (17) with a tape cutting heater (21) movable to cut a tape;

c. a tape pay-off reel (13) in said case for feeding a thermoplastic tape along the travel path defined by said tape guide channel (12) and said tape table (17), up through one opening around a package and then through another opening below said table, tension rollers along said travel path to control the tension on said tape;

d. a first clamping element (18) with an aperture (26) for the tape to pass therethrough, to one side of the cutting heater (21), said first clamping element being elevatable towards the table so as to hold the end portion of the tape against said tape table;

e. a second clamping element (23) on the other side of the cutting heater (21) elevatable towards said tape table so as to hold overlapping portions of a tape against said tape table;

f. a pressing element (22) elevatable towards said table so as to press the overlapping portions of the tape against said tape table;

g. time control cams coupled to said first clamping means, tape guide element, pressing element and second clamping elements, all said elements being successively aligned in the lengthwise direction of said tape and adapted to be directly contacted by said control cams to control these elements in time relation with each other;

h. a welding heater adapted to be tranversely inserted between the overlapping portions of the tape to be pressed against said table by said pressing element; and i. a bimetal element temperature control connected to said welding heater for controlling its heating temperature at two separate temperature ranges, first between about 500° C to about 700° C, and after a predetermined time lapse to between about 400° to about 500° C and means to insert said welding heater (25) between said overlapping portions at said lower temperature.

* * * * *